US005562288A

United States Patent [19]

Erkebaev

[11] Patent Number: 5,562,288

[45] Date of Patent: Oct. 8, 1996

[54] PORTABLE ELASTIC SPORTS GOAL

[76] Inventor: Eskendr B. Erkebaev, P.O. Box 439, Big Bear City, Calif. 92314

[21] Appl. No.: 493,212

[22] Filed: Jun. 20, 1995

[51] Int. Cl.[6] ..... A63B 63/04

[52] U.S. Cl. ..... 273/396; 273/400; 473/197

[58] Field of Search ..... 273/400, 181 F, 273/394, 395, 396, 411

[56] References Cited

U.S. PATENT DOCUMENTS

| | | | |
|---|---|---|---|
| 3,184,235 | 5/1965 | Hilbrich | 273/181 FX |
| 3,195,898 | 7/1965 | Respini | 273/181 F |
| 4,083,561 | 4/1978 | Daffer, Jr. | 273/411 X |
| 4,842,284 | 6/1989 | Rushing et al. | 273/395 |
| 5,048,844 | 9/1991 | Haseltine | 273/400 |
| 5,080,375 | 1/1992 | Moosavi | 273/400 |
| 5,088,740 | 2/1992 | Peterson | 273/410 |
| 5,186,469 | 2/1993 | Terris | 273/400 |
| 5,244,213 | 9/1993 | Armell | 273/400 |
| 5,308,083 | 5/1994 | Grunfeld et al. | 273/400 |
| 5,342,063 | 8/1994 | O'Brien | 273/396 |

*Primary Examiner*—William H. Grieb

[57] ABSTRACT

A portable sports goal (20) comprising a net (22), multisectional resilient poles (24), a connector (26), a support (30) and retainers (32). Corners of the net are connected in easily removable way to outer ends of the resilient poles. Resilient poles, connected together by the connector, exert stretching force along diagonals of the net. A net-poles-connector assembly (31) is maintained in a generally upright position by the support, attached to the connector. Two bottom corners of said assembly are secured to a playing surface by the retainers. A size of the goal can be changed by varying the number of the sections of the resilient poles. The support has adjustable length so, that the net-poles-connector assembly can be set with any of its sides on the playing surface. The angle between the net and the playing surface is adjusted by varying the length of the support and its position relatively to the net. Several goals can be easily connected together to form a goal or a backstop of a larger size. An interaction between the goal and a game projectile, struck therein, is similar to that of a bow and an arrow.

22 Claims, 4 Drawing Sheets

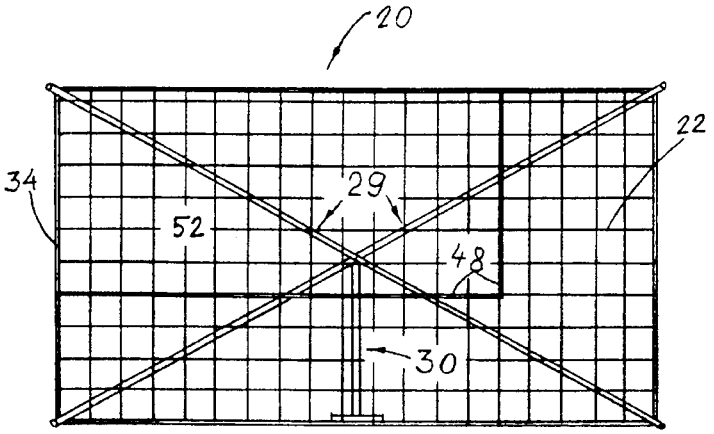
FIG. 10 A
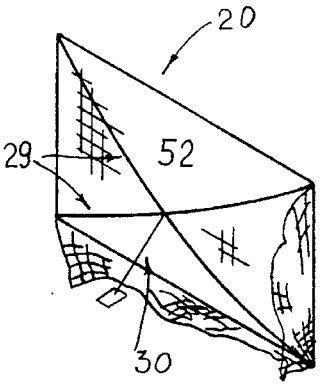
FIG. 10 B
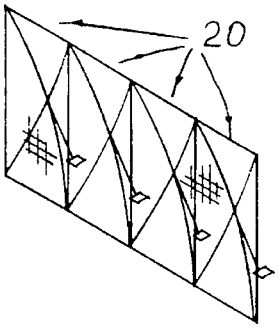
FIG. 11 A
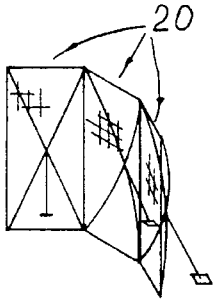
FIG. 11 B
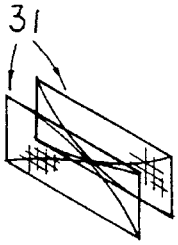
FIG. 11 C
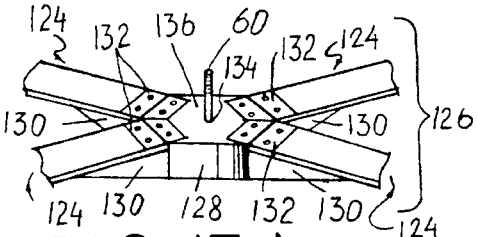
FIG. 13 A
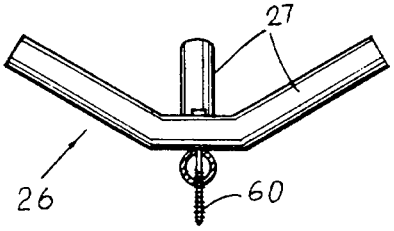
FIG. 12
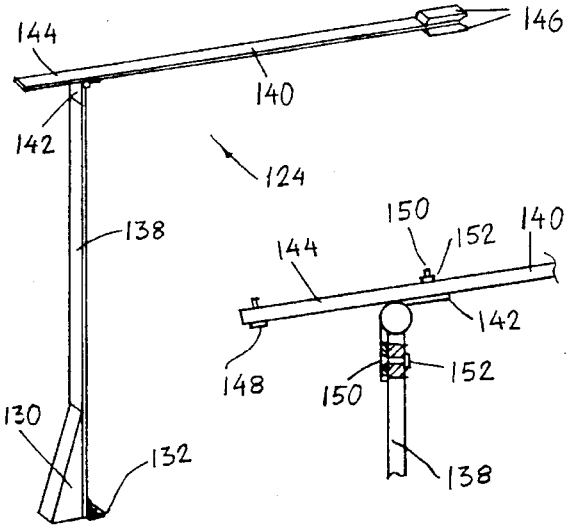
FIG. 13 B
FIG. 13 C

PORTABLE ELASTIC SPORTS GOAL

BACKGROUND—FIELD OF INVENTION

This invention is concerned with a portable sports goal.

BACKGROUND-DESCRIPTION OF PRIOR ART

Many sports utilize game projectiles in form of balls or pucks with rectangular net arrangements. In some of them (soccer, hockey, lacrosse, etc.) the projectile has to be struck into the net arrangement to score. In others (golf, baseball, football, etc.) similar arrangments are used for practices as rebounders and backstops. Very often these sports are practiced in places not completely designed for the purposes of the given sport (backyards, beaches, alleys, etc.). To practice in such places players need a net arrangement which they can easily assemble for use and disassemble for transportation and storage, and which provides a close approximation of the regulation-type goals. A great variety of portable net arrangements are presently manufactured to meet this need: Soccer Rebounder™ of Jafco Manufacturing, shown on the company leaflet; Portable/Transportable Soccer Goal shown on page 3 and STG shown on page 4 of Goal Sporting Goods catalog, effective 07/94–05/95; Wiel Coerver Outdoor Training Goal of Kwik Goal Ltd., shown on page 30 of 1994 company catalog. Many others are disclosed in patents and other publications: Foldable Soccer Goal for Easy Storage of U.S. Pat. No. 5,186,469 (1993) to Terris, Portable Rebounding Soccer Goal of U.S. Pat. No. 5,048,844 (1991) to Haseltine, Center Soccer Two Way Goal of U.S. Pat. No. 4,842,248 (1989) to Rushing et al., Soccer practice net of U.S. Pat. No. 4,083,561 (1978) to Daffer. All the goals cited use a rigid frame similar to that of regulation goals, which makes them rather heavy and bulky when they are collapsed for storage and transportation.

U.S. Pat. No. 3,184,235 to Hilbrich (1965) discloses a portable backstop whose set and collapse times are very short due to umbrella-like design; however after collapsing it still presents a rather big and heavy object. The design and materials involved require some rather expensive manufacturing processes.

U.S. Pat. No. 3,195,898 to Respini (1965) discloses net supporting arrangement utilizing as support elements two resilient poles, substantially bent in a use mode. It allows to make these support elements lighter, than those, used in rigid frames. In one of the embodiments, though, these resilient poles extend beyond the surface of the net in the use mode, which can present inordinate obstruction for the players or the game projectile. In another embodiment, rather complex base support elements are used.

Portable Sports Goal disclosed in U.S. Pat. No. 5,244,213 to Armell (1993) employs flexible light multisectional poles, usually used in dome tents, instead of rigid structural elements of conventional goals. For this reason it is very light and compact when collapsed, and safe if a player runs into it. This goal, though, can provide only a poor approximation of a regular goal, since it has semicircular shape.

Practice Backstop for Ball Playing Sports disclosed in U.S. Pat. No. 5,088,740 to Peterson (1992) presents a tent-like construction, whose set and collapsing times are rather long since they are comparable to that of regular dome tents. Beside the net itself, it also includes extra fabric material, which makes it more expensive and space-consuming. Moreover, the shape of a net, as in the goal of Armell, is non-rectangular.

All the constructions mentioned above are of the fixed sizes. It is often desired, though, that the net arrangement can be adjusted in size and shape depending on practice requirements and space availability. Standard Kwik Soccer Goal, shown on page 16 of cited catalog of Kwik Goal Ltd. and Adjustable Soccer Goal of U.S. Pat. No. 5,080,375 (1992) to Moosavi have adjustable sizes so, that they can be used on the fields of various sizes and by the players of various ages, but since they use rigid frames, they are rather heavy and bulky when collapsed. Moreover, only a width of Standard Kwik Soccer Goal can be changed, whereas the height remains the same.

Very often it is also desirable that the net arrangement can be set both vertically and at some angle to the vertical, so as to enhance rebound of the projectile up or down. Rebounding portable soccer goal of U.S. Pat. No. 5,308,083 (1994) to Grunfeld et al., Baseball Rebounder B-24 shown on page 84 and Kwik Rebounder KR-2N shown on page 32 of cited catalog of Kwik Goal Ltd. and Soccer Kick Rebounder SKR1 shown on page 5 of cited Goal Sporting Goods catalog can be tilted to meet this need, though they are rather heavy and bulky when collapsed since they use rigid frames.

Rebounding properties of most of the designs mentioned above are limited by the low resilience of their nets and massive frames.

All the net arrangements heretofore known suffer from the following disadvantages:

a) They are designed to be set while oriented in one certain manner, usually with a longer side on the playing surface (i.e. elongated horizontally). It's desirable to be able to change net orientation depending on practice or terrain requirements. For instance, in most practice games the net has to be oriented with the longer side on the playing surface, while in many shooting or kicking practices or when used as a backstop it's often better to have the shorter side on the playing surface (i.e. elongated vertically).

b) They are designed to be used individually, so that they cannot be readily used as modules for assembling net arrangements of larger area and/or different shape. For instance, it is desirable to have several small-size goals which can be used by players for individual home practices and can be assembled into a larger goal for team practices.

OBJECTIVES AND ADVANTAGES

Accordingly, several objectives and advantages of the present invention are:

a) to provide a goal which is a good approximation of regulation goals, lightweight, compact when collapsed for storage and transportation, inexpensive and has high rebounding properties;

b) to provide a goal which can be easily set on both hard (floors of gyms, paved driveways, decks, etc.) and soft (soccer fields, beaches, etc.) playing surfaces;

c) to provide a goal whose size and shape can be varied depending on practice requirements and space availability;

d) to provide a goal which can be set vertically and which can also be tilted to the player to enhance a rebound of the projectile down, or from the player to enhance a rebound of the projectile up;

e) to provide a goal which can be set both in the position with the longer side on the playing surface and in the position with the shorter side on the playing surface;

f) to provide a goal several of which can be readily put together for creating net surfaces of larger areas and various shapes;

Further objectives and advantages will be apparent from a consideration of the ensuing description and drawings.

DRAWING FIGURES

In the drawings, closely related figures have the same number but different alphabetic suffixes.

Figure 3A:
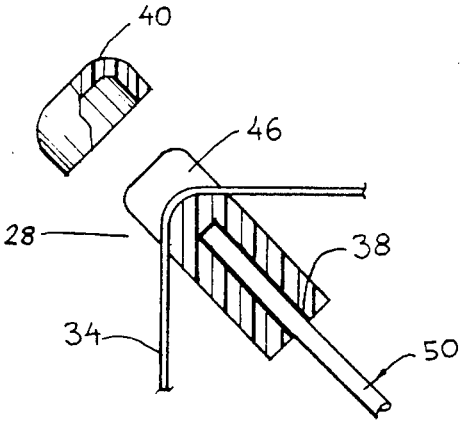
Figure 3B:
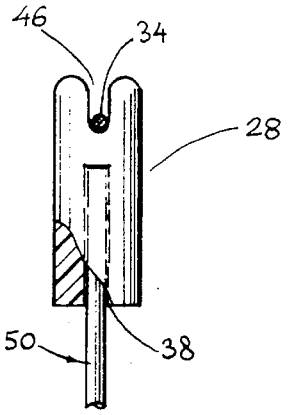

FIG. 3 A, B show various aspects of the connecting nozzle of this invention.

Figure 4:
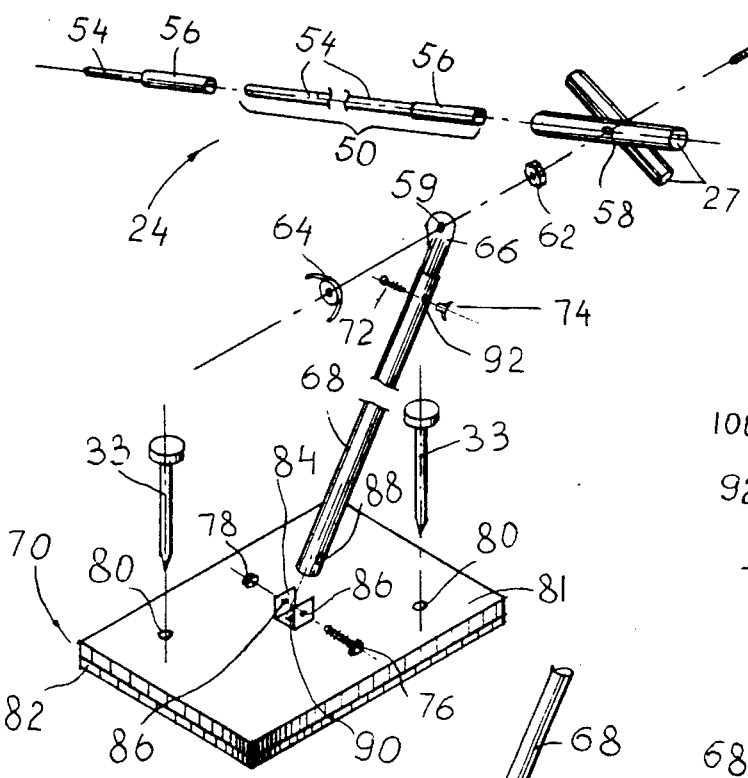

FIG. 4 shows in detail the support, the connector, and one of the resilient poles of this invention.

Figure 5:
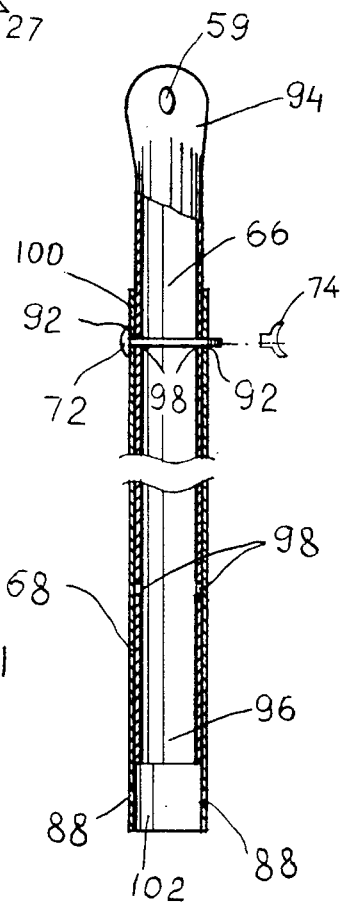

FIG. 5 shows in detail the telescopic tubes of the support of this invention.

Figure 6:
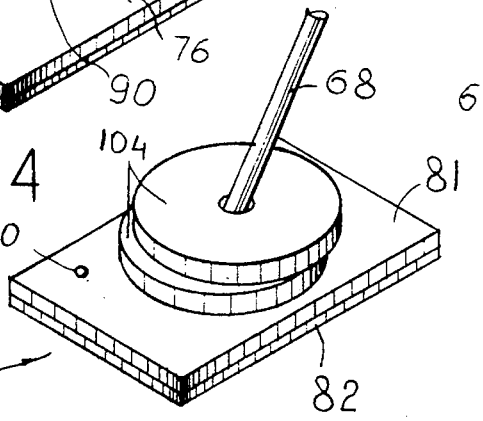

FIG. 6 shows in detail a fragment of the support of this invention with the weights placed thereon as in use on hard playing surfaces.

Figure 7A:
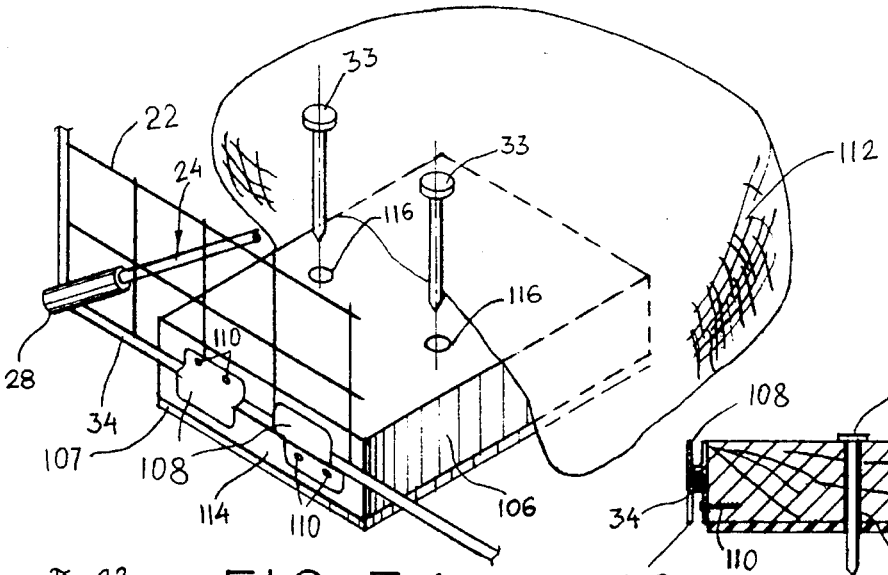

FIG. 7 A, B show various aspects of the retainer of this invention as in use on soft playing surfaces.

Figure 8A:
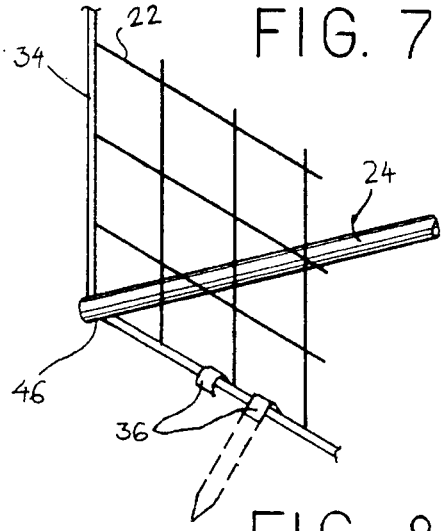
Figure 8B:
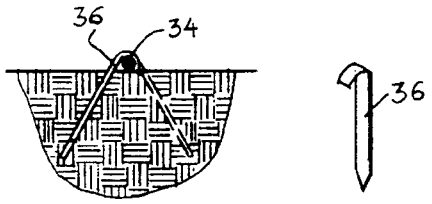

FIG. 8 A, B show various aspects of retaining a lower comer of the goal of this invention with inverted J-shaped stakes.

Figure 9A:
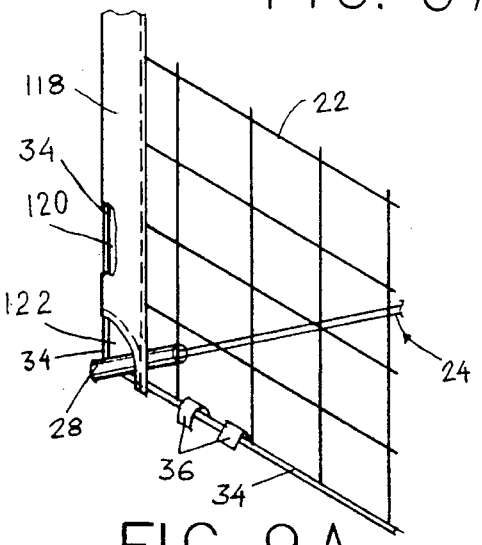
Figure 9B:
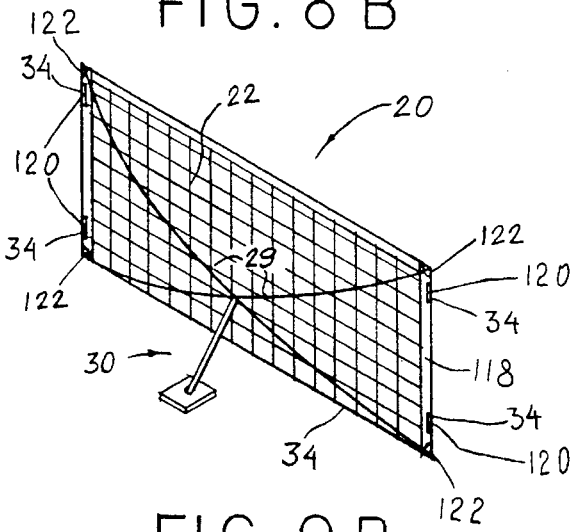

FIG. 9 A, B show various aspects of the net of this invention, supplied with the peripheral tape.

FIG. 10 A, B show various aspects of the net of this invention supplied with the additional cord.

FIG. 11 A to C show various aspects of use of several goals of this invention as modules for constructing larger net arrangements.

FIG. 12 shows the alternative embodiment of the connector of this invention.

FIG. 13 A to C show the alternative embodiment of the poles and the connector of this invention.

| Reference Numerals in Drawings |
|---|
| 20 goal |
| 22 net |
| 24 resilient pole |
| 26 connector |
| 27 tube |
| 28 connecting nozzle |
| 29 stretching member |
| 30 support |
| 31 net-poles-connector assembly |
| 32 retainer |
| 33 stake |
| 34 cord |
| 35 comer |
| 36 J-shaped stake |
| 28 hole |
| 40 cap |
| 42 inside end of nozzle 28 |
| 44 outside end of nozzle 28 |
| 46 notch |
| 48 additional cord |
| 50 segment of resilient pole 24 |
| 52 section of net 22 |

-continued

| Reference Numerals in Drawings |
|---|
| defined by cord 48 |
| 54 linear member |
| 56 sleeve |
| 58 hole |
| 59 oval hole |
| 60 screw |
| 62 nut |
| 64 nut |
| 66 inner tube |
| 68 outer tube |
| 70 base |
| 72 screw |
| 74 nut |
| 76 screw |
| 78 nut |
| 80 hole |
| 81 platform |
| 82 pad |
| 84 U-shaped connector |
| 86 hole |
| 88 hole |
| 90 screw |
| 92 hole |
| 94 upper end of inner tube 66 |
| 96 lower end of inner tube 66 |
| 98 hole |
| 100 upper end of outer tube 68 |
| 102 lower end of outer tube 68 |
| 104 plate |
| 106 platform |
| 107 pad |
| 108 hook |
| 110 screw |
| 112 weight |
| 114 front end of platform 106 |
| 116 hole |
| 118 tape |
| 120 window |
| 122 window |
| 124 resilient arm |
| 126 stretching assembly |
| 128 central block |
| 130 arrester |
| 132 hinge |
| 134 hole |
| 136 base |
| 138 section of arm 124 |
| 140 section of arm 124 |
| 142 hinge |
| 144 stopping part |
| 146 connecting plate |
| 148 stopping screw |
| 150 screw |
| 152 nut. |

DESCRIPTION OF THE INVENTION

Figure 1:
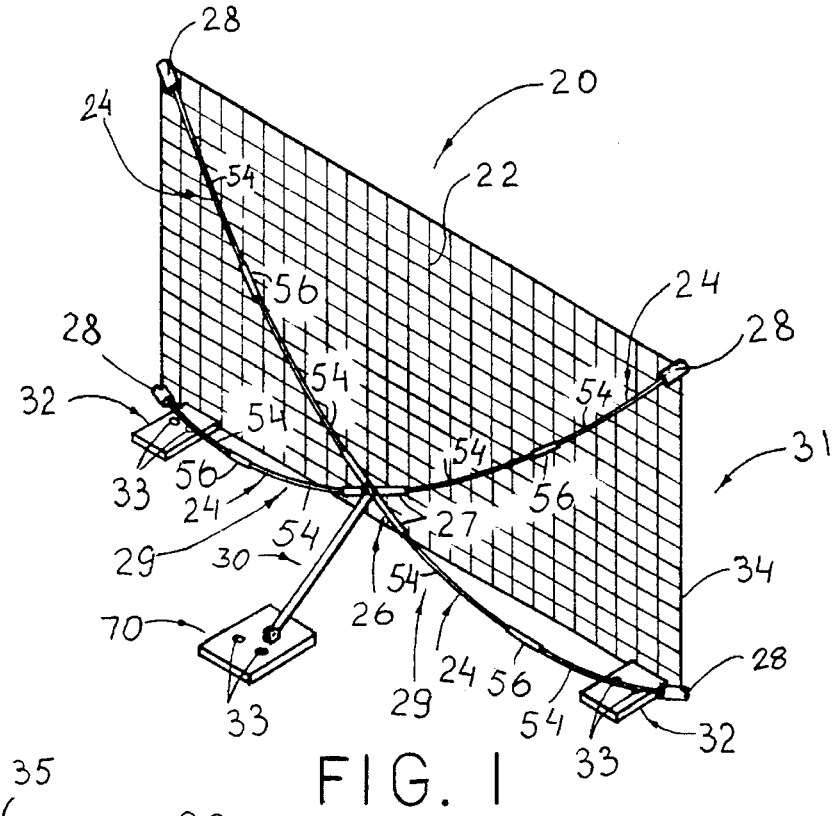
FIG. 1 is a back perspective view of the sports goal of this invention in regular operational mode.
Figure 2:
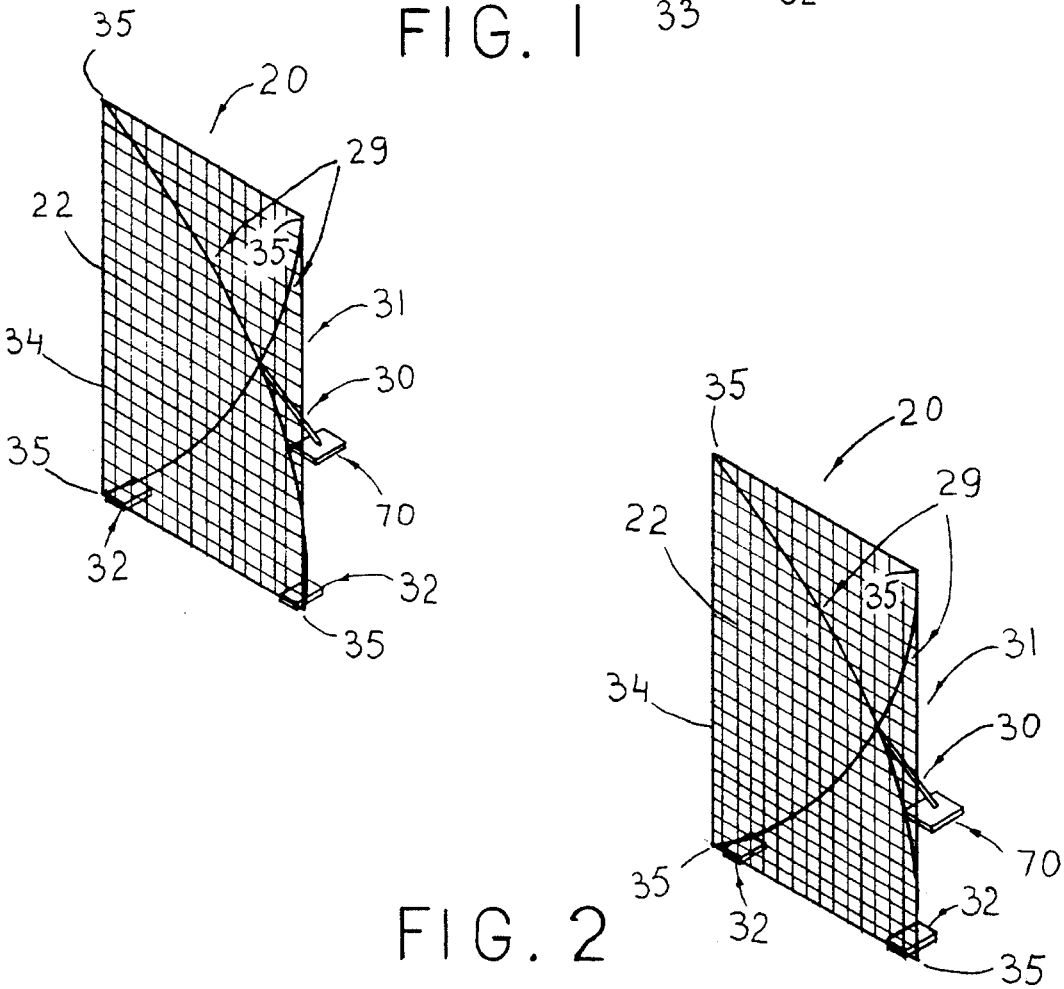
FIG. 2 is a front perspective view of two sports goals of this invention set for shooting practice in auxiliary operational mode.

A regular operational mode of the typical embodiment of a portable elastic sports goal 20 of this invention is shown in FIG. 1. Two goals 20 in an auxiliary operational mode are shown in FIG. 2. With reference to FIG. 1, 2 it may be seen in overview that the preferred embodiment of the present invention includes a net 22, four resilient poles 24, a connector 26, four connecting nozzles 28, a support 30, two retainers 32 and a plurality of stakes 33. When in use, net 22 is stretched in its operational shape by resilient poles 24. Resilient poles 24 are attached to the corners of net 22 by four connecting nozzles 28. Resilient poles 24 are connected to each other by connector 26 and are bent like bows by the tension of net 22. When assembled for use, net 22, nozzles 28, poles 24 and connector 26 comprise a net-poles-connector assembly 31. Assembly 31 is secured to the playing surface at its bottom corners by retainers 32 and is maintained in generally upright position by support 30, attached to connector 26. Dimensions and materials of the parts employed provide enough resilience and strength to keep goal 20 in an operational mode and to withstand an impact of a game projectile without breaking.

Having described the preferred embodiment of the present ,invention in overview, more detailed description now follows.

Net 22 of the preferred embodiment of the present invention creates a projectile-receiving member of generally rectangular or other quadrilateral shape with four corners 35. Depending on the intended use, net 22 can be made of any open, mesh-like material, solid flexible sheet material, or any equivalent material. A reinforcing cord 34 is threaded through net 22 around the periphery thereof. Cord 34 may be formed of the same or different material than net 22. In either case it is preferable, that cord 34 and net 22 are made of materials that can withstand the stress of resilient poles 24 without significant changes in size. It is also preferable, that cord 34 can withstand a long lasting friction of retainers 32 and nozzles 28. It is further preferred, that the materials of net 22 and cord 34 can withstand long exposure to weather elements.

As was mentioned above, nozzles 28 connect poles 24 to the corners 35 of net 22. Connecting nozzle 28 is best seen in FIG. 3 A, B. Nozzle 28 of the preferred embodiment of the present invention is of generally oblong cylindrical shape and is formed of plastic, rigid rubber, wood or the like material, though other shapes and materials can also be used. The diameter of nozzle 28 is substantially larger than the diameters of cord 34 and resilient poles 24. Nozzle 28 has a fork-like outside end 44 and an inside end 42. Outside end 44 of nozzle 28 is rounded for protection of users and game projectiles. To further increase the safety of operation, protective caps 40, similar to caps used for PVC pipes, can be put on outside ends 44 after connecting nozzles 28 to net 22. Outside end 44 has a notch 46 for receiving a comer of net 22. Notch 46 is deep enough to provide a reliable retention of cord 34. Notch 46 can, of course take different shapes, but in any case, it is preferred, that all edges of notch 46 are rounded to decrease the damage to cord 34. Inside end 42 of nozzle 28 has a hole 38 for receiving resilient pole 24. The diameter of hole 38 is slightly larger than the outer diameter of resilient pole 24 for making a telescoping function connection therewith. As can be seen from the above description, nozzles 28 provide fast and simple connection between net 22 and resilient poles 24.

Each resilient pole 24 consists of one or more pole segments 50, connected in a way well known in the art of making of fishing poles and tents. As best seen in FIG. 4, typical pole segment 50 of the preferred embodiment of the present invention consists of a linear member 54 and a sleeve 56. Typical linear member 54 is formed of a plastic or fiberglass cylinder or tube of the type, used for snowmobile flags, fishing rods, or tents, though other materials and cross-sectional shapes can also be used. It is preferred, that sleeve 56 is formed of metal tube, though other materials can also be used. Sleeve 56 is attached to linear member 54 by a glue or other means. To facilitate quick assembling, it is preferable that nozzle 28 is permanently kept on the corresponding pole segment 50. In use, one of the ends of assembled pole 24 is inserted into nozzle 28, another, inner end is inserted into connector 26.

Connector 26 of the preferred embodiment of the present invention is formed of two metal tubes 27, a screw 60 and a nut 62 and is best seen in FIG. 4. The size of tubes 27 allows for telescoping friction connection with resilient poles 24. Each tube 27 telescopically receives inner ends of two poles 24, one at each of its opposite receiving ends. Diametrically through holes 58 are bored through the middles of tubes 27 to receive screw 60. It is preferred, that screw 60 is put through tubes 27 and that nut 62 is threaded upon screw 60 permanently so as to abut tubes 27 to each other but still to allow independent rotation of tubes 27 around screw 60. When inserted into tube 27 pole 24 abuts against screw 60 which arrests further penetration of pole 24 into tube 27. Two oppositely extending poles 24 with tube 27 in which they are inserted and two nozzles 28 put on their ends constitute a diagonal stretching member 29. The ends of stretching member 29 are attached to two diagonally opposite corners 35 of net 22. Stretching member 29 is substantially longer than the corresponding diagonal of net 22. After inserting in connector 26, four poles 24 with two tubes 27 and four nozzles 28 constitute two stretching members 29 pivotally connected by screw 60 in the middles thereof. This connection is simple and inexpensive. When in the transportation mode, two tubes 27 can be turned parallel to each other to consume a minimum of space. Pivotally connected stretching members 29 exert stretching force strictly along net's diagonals regardless of the angle between these diagonals. It makes stretching force in net 22 more uniform and allows for using the same stretching members 29 with nets 22 of various shapes as far as their diagonals of the appropriate length. It also eliminates inordinate stress in connector 26 and inner end of poles 24. Screw 60 is dimensioned so as after connecting tubes 27 it has enough length left to put it through a hole 59 of support 30 and thread a nut 64 thereon. As can be seen, screw 60 has three different functions: stopping poles 24 in tubes 27, connecting tubes 27 to each other and providing a connection to support 30.

As was said, net 22, poles 24 with nozzles 28 and connector 26 after putting together comprise net-poles-connector assembly 31 which can be maintained on the playing surface in various positions by two retainers 32 and support 30.

As best seen in FIG. 4, 5, support 30 consists of two telescopic tubes 66, 68, and a base 70, connected by screws 72, 76 and nuts 74, 78. In use, support 30 maintains net-poles-connector assembly 31 in such a position that the plane of net 22 is generally upright. As said before, the upper end of support 30 is attached to connector 26 by screw 60 and nut 64. The lower end of support 30 consists of base 70, secured to the playing surface. The length of support 30 can be adjusted depending on the operational mode of goal 20 by moving telescopic tubes 66, 68 relatively to each other.

Telescopic tubes 66, 68 of the preferred embodiment of the present invention are formed of metal, though other materials can also be used. As best seen in FIG. 4, 5, inner tube 66 has an upper end 94 and a lower end 96. Upper end 94 of inner tube 66 is flattened and bent and has a hole 59 for receiving screw 60. Hole 59 is made of slightly oval shape elongated generally vertically so that support 30 can be tilted to various angles relatively to screw 60. Two or more holes 98 are bored diametrically through inner tube 66 to receive screw 72. Outer tube 68 has an upper end 100 and a lower end 102. A diametrically through hole 92 is bored through upper end 100 of outer tube 68 for receiving screw 72. When put through holes 92, 98, screw 72 provides the connection between inner tube 66 and outer tube 68. To vary the length of support 30, different holes 98 can be used for said connection. Nut 74 is threaded on screw 72 to keep screw 72 in holes 92,98. Lower end 102 of outer tube 68 has a hole 88 for receiving screw 76 which attaches it to base 70.

As is shown in FIG. 4, 6 base 70 of the preferred embodiment of the present invention consists of a flat rectangular metal, plastic or plywood platform 81 with a high-friction pad 82 attached to the bottom and a U-shaped metal connector 84 attached to the top thereof, though other shapes and materials can also be used. Platform 81 has dimensions sufficient for placing weights thereon. Connector 84 is attached to platform 81 by screw 90 or other means. Two concentric holes 86 are bored through vertical sections of connector 84 for receiving screw 76.

To attach base 70 to tube 68, lower end 102 of tube 68 is inserted into U-shaped connector 84, then screw 76 is put through holes 86, 88 and nut 78 is threaded on screw 76. It is preferable, that, for quickness of setting up and removing, base 70 and tubes 66, 68 are permanently kept assembled together.

Two or more holes 80 are bored through base 70 as shown in FIG. 4, 6 for receiving stakes 33. To secure base 70 to the ground, stakes 33 are driven therein through holes 80. To secure base 70 to hard surfaces (floors of gyms, pavements, hard soil, etc.) weights of various nature can be employed. For instance, as is best seen in FIG. 6, plates 104 used in any gym for weight lifting can be put on base 70 before connecting support 30 to connector 26. Sandbags, bags filled with rocks or any other heavy object can also be employed. To increase friction between platform 81 and smooth playing surfaces (like floors of gyms) pad 82 made of rubber or other high-friction non-marking material is attached to the bottom of platform 81 by glue or other means.

Figure 7B:
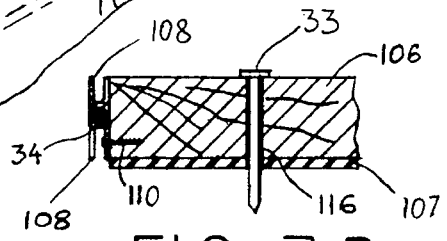

As can be seen, support 30 provides one point of support for net-poles-connector assembly 31. Two more points of support are provided by two retainers 32, shown in FIG. 7 A, B. Retainer 32 of the preferred embodiment of the present invention includes a platform 106 with two hooks 108 attached to a front end 114 thereof. Platform 106 is preferably formed of a rectangular wooden, metal or plastic board, though other materials and shapes can also be used. Platform 106 has dimensions sufficient for placing a weight 112 thereon and attaching hooks 108 to front end 114 thereof. Two generally vertically and oppositely oriented hooks 108 are attached by screws 110 to front end 114 of platform 106 in the manner, best seen in FIG. 7 A, B. The distance between hooks 108 is larger than the diameter of cord 34, so as to allow for cord 34 to be placed between hooks 108 in the process of assembly. Hook 108 of the preferred embodiment of the present invention is formed of flat and generally rectangular peace of metal with rounded corners and in cross-section takes form of vertically stretched N. Hooks 108 are dimensioned and mounted on front end 114 so that stretched cord 34 fits in space formed by hooks 108 and front end 114 as is shown in FIG. 7B. One or more holes 116 are bored vertically through platform 106 for receiving stakes 33. To secure retainer 32 to soft surfaces, stakes 33 are driven through holes 116 in a manner, best seen in FIG. 7 B. To secure retainer 32 to hard surfaces (floors of gyms, pavements, hard soil, etc.) ,weights 112 of various nature (for instance, sandbags, rocks, metal plates etc.) can be put on platform 106 in a manner best seen in FIG. 7 A. To increase friction between platform 106 and smooth playing surface (like floor of a gym) pad 107 made of rubber or other high-friction non-marking material is attached to the bottom of platform 106 by glue or other means.

ASSEMBLY

It may now be understood that the portable elastic sports goal of this invention may be assembled according to the following steps:

a) assembling resilient poles 24 and inserting resilient poles 24 into connector 26;

b) if nozzles 28 were kept separately, putting nozzles 28 onto outer ends of resilient poles 24;

c) turning nozzles 28 around their longitudinal axes to align notches 46 so that they are ready to receive corners 35 of net 22;

d) spreading net 22 on the playing surface;

e) engaging two nozzles 28 of different diagonal stretching members 29 with the corners 35 of net 22 adjacent to one of the sides of net 22 by inserting said corners 35 into notches 46 of said nozzles 28;

f) engaging one of the still unengaged corners 35 of net 22 with the corresponding nozzle 28 by pulling said corner 35 with one hand and holding the corresponding nozzle 28 in another hand and inserting said corner 35 into notch 46 of said nozzle 28;

g) engaging the last unengaged corner 35 with the corresponding nozzle 28 by repeating the actions of the previous step;

h) placing obtained net-poles-connector assembly 31 on a playing surface so that net 22 is flat on the playing surface and the net edge which is planned to be at the bottom is aligned with the desired goal orientation;

i) putting retainer 32 vertically against the bottom edge of net 22 close to one of the corners 35 so, that front end 114 abuts cord 34 in the space between hooks 108;

j) turning retainer 32 about 90° around the vertical axis so, that hooks 108 engage with cord 34;

k) putting retainer 32 flat on the playing surface and securing it thereon by driving stakes 33 through holes 116 or putting weights on platform 106;

l) repeating the actions of three previous steps for another retainer 32 close to another bottom corner 35;

m) lifting net-poles-connector assembly 31 while turning it around the bottom edge of net 22 until the plane of net 22 is in the desired upright position;

n) unthreading nut 64 and putting screw 60 through hole 59 of support 30;

o) aligning base 70 of support 30 on the playing surface, adjusting the length of support 30 and securing base 70 on the playing surface by driving stakes 33 through holes 80 or putting weights on base 70;

p) threading nut 64 on screw 60.

Disassembling is accomplished by reversing of foregoing steps.

ALTERNATIVE EMBODIMENTS

The foregoing description included standard retainers 32 for use on both hard and soft surfaces. As best seen in FIG. 8 A, B, to secure a bottom corner of net-poles-connector assembly 31 to the soft surface, two reversed J-shaped stakes 36 can be employed. Stakes 36 are preferably formed of flat metal and have substantially oblong shape. As is shown in FIG. 8 B, one end of stake 36 is sharpened, another is bent to form a hook. Stakes 36 are driven into the ground in slightly spaced relation at both sides of cord 34 so that their hooked ends engage therewith. To enhance retention, stake 36 is preferably tilted at approximately 45° in the direction of the hooked end (see FIG. 8 B).

The foregoing description included connecting nozzles 28. If resilient poles 24 are thick enough, net receiving notches 46 can be made in the bodies of resilient poles 24 to provide connection without using nozzles 28, as is shown in FIG. 8 A.

Net 22 can be provided with an additional cord 48 threaded therethrough to define a smaller rectangular section 52 of net 22 as is shown in FIG. 10 A. If cord 48 is attached to poles 24 during goal assembly, only section 52 will be stretched and erected after goal 20 is completely set. The rest of net 22 can be arranged behind the plane of section 52, as is shown in FIG. 10 B. The section of net 22 which is actually stretched by poles 24 is called hereinafter an effective section 52 of net 22. The size of goal 20 is defined by the size of effective section 52. To fit the varying size of effective section 52, the lengths of poles 24 are adjusted by varying the number of segments 50 of which they consist. Segments 50 of poles 24 are dimensioned accordingly. More than one cord 48 can be threaded through net 22 to provide several possible sizes of goal 20. Since stretching members 29 are connected to each other pivotally, they can be used with effective section 52 of any shape as far, as the diagonals of effective section 52 are of the appropriate length.

As is shown in FIG. 9 A, B, a tape 118 of the type used for volleyball nets can be attached to the sides and the upper edge of net 22. In the regular operational mode tape 118 represents vertical posts and a horizontal crossbar of a conventional sports goal. Tape 118 can be attached to net 22 by stitching, cementing or other means. Two windows 120 are made in tape 118 at sections, representing posts so that cord 34 is exposed for connecting with retainers 32 in auxiliary operational mode. Four windows 122 are made in tape 118 at corners 35 of net 22 to expose cord 34 for connecting with nozzles 28. Similar tapes can be attached to additional cord(s) 48 (not shown).

The foregoing description included reinforcing cords 34, 48. If the mesh material of net 22 is strong enough, net 22 can be used without cords 34, 48 (not shown). By changing the size of poles 24 and attaching poles 24 to different meshes of net 22 one can vary the size and the shape of goal 20 as was described above.

The foregoing description included net 22 made of a mesh material. A solid flexible sheet material can be used instead (not shown). A periphery of net can be folded over cord 34 and stitched to itself similar to tape 118. To expose cord 34 for connecting with nozzles 28 and with connectors 32, windows similar to windows 120 and 122 have to be made in net 22.

The foregoing description included connector 26 with straight tubes 27. To increase the distance between the plane of net 22 and connector 26, tubes 27 can be bent to form an open V, as shown in FIG. 12.

The foregoing description included connector 26 including two tubes 27 to provide telescopic connection with poles 24. To facilitate quick assembling, resilient poles can be permanently hinged to a connecting member to comprise a stretching assembly so, that during the assembling one needs only to unfold it into an operational position, FIG. 13 A to C show a stretching assembly 126 consisting of a central block 128, four hinges 132, screw 60, resilient arms 124 and arresters 130. Central block 128 is formed of plastic, wood or the like material and takes form of a hexagonal prism so formed and oriented, that its bases 136 are generally parallel to net 22 and four of its six sides face corners 35 of net 22. A hole 134 is bored through the center of block 128 perpendicular to bases 136 to receive screw 60. Screw 60 is put through hole 134 with its threaded part pointed back. To further facilitate quick assembling, screw 60 can be permanently attached to block 128 by threading or other means. Four resilient arms 124 are attached by hinges 132 to four sides of back base 136 so, that in use they are pointed toward corners 35 of net 22 and when folded they are generally parallel to screw 60. Resilient arms 124 are formed of flat oblong pieces of resilient plastic, metal or the like material. When unfolding, the forward motion of arms 124 is arrested in the operational position by arresters 130 attached thereto. Arrester 130 is formed of plastic, wood or the like material and takes shape of a triangular prism having elongated triangle bases, two long and one short rectangular sides. One of the long sides of arrester 130 is attached to the hinged end of arm 124 by a glue, screws or other means so, that its short side abuts the side of block 128 in the operational position.

As is shown in FIG. 13 B, arm 124 consists of two sections 138, 140 connected by a hinge 142. Arm section 140 has a stopping part 144 extending beyond the hinged end and connecting plates 146 attached to the free end thereof. Stopping pad 144 arrests circular motion of section 140 around hinge 142 in the operational position. Connecting plates 146 are attached to the outer end of arm 124 comprising a fork-like construction for retaining of one of the corners 35 of net 22 and are formed of plastic, metal, or the like material.

As is shown in FIG. 13 C, hinge 142 is attached to sections 138, 140 by screws 150 and flat nuts 152. To provide a contact point at the end of stopping pad 144 in the operational position, a stopping screw 148 is threaded into the end of stopping pad 144. Nuts 152 are flat so that they present no obstruction for motion of section 140 into folded position.

As is shown in FIG. 11 A to C, several goals 20 or assemblies 31 can be used as modules to form goals or backstops of greater areas. To provide connections between two modules, VELCRO® fasteners or the like can be used in the obvious way (not shown).

OPERATION

It is obvious from the above description, that goal 20 of the present invention can be used as a goal, a rebounder or a backstop in many games and sports involving balls, pucks or other projectiles. When the game projectile enters goal 20 it travels some distance in, pushing net 22, which in turn pulls the ends of poles 24. The tension of net 22 increases and poles 24 bend more until the projectile loses its momentum and stops. Then, because of their resilient nature, poles 24 spring back, stretching net 22, which in turn pushes projectile back to the field. The whole operation is similar to that of a bow and an arrow. Kinetic energy of the moving projectile transforms into potential energy of poles 24 deformation, then this potential energy transforms back into kinetic energy of reverse movement of the projectile. Since poles 24 possess high resilient properties, the energy loss during said transformations is minimal and the projectile has the reverse speed close to the speed which it had before entering goal 20.

The playing surface does not require any special preparation for setting goal 20. Any backyard, beach, driveway, deck or similar area can be used for setting goal 20. By adjusting support 30, net 22 can be set generally vertically even on inclined surfaces. Also by adjusting support 30, net 22 can be tilted to face slightly up or down to facilitate rebound of projectile correspondingly upward or downward.

Depending on the space available or the purpose of the practice, the size of goal 20 can be changed. For instance, in tight areas or in small-field soccer games, goal 20 can be assembled in its reduced version using additional cord 48 and a reduced number of pole segments 50, as is shown in FIG. 10 B. The same goal 20 can be used full-sized if practice requires and space permits, as is shown in FIG. 10 A.

When a player runs into or falls onto goal 20, it easily deforms returning to its normal shape after pressure is removed. Since no rigid elements of goal 20 are exposed to players, the chance of injury because of collision is reduced in comparison with conventional goals.

Two or more goals 20 can be used together, to imitate a goal of larger size, as seen in FIG. 11 A; to create backstops of various shapes, as seen in FIG. 11 B; or to constitute various practice combinations. For instance, in soccer it is advantageous to kick the ball into the goal closer to a periphery thereof so, that a goal keeper can not stop it. To practice this type of kicking two goals 20 can be set in auxiliary operational mode, as is seen in FIG. 2. Goals 20 in FIG. 2 are preferably sized and spaced to imitate outermost portions of a regulation-size goal. The player's objective is to kick the ball into one the of goals 20. If the ball hits one of the goals 20, it rebounds back, if not, the player has to chase it. As is shown in FIG. 11 C, two net-poles-connector assemblies 31 can be put together 'back -to back' to comprise a two-way rebounder without using supports 30.

SUMMARY, RAMIFICATIONS, AND SCOPE

1. Accordingly, the reader will see, that the portable elastic goal of this invention provides a sports goal having the following advantages over conventional goals:

(a) it is light, compact in transportation mode, and inexpensive. An outline of a conventional goal is formed by a heavy and bulky rigid frame. The outline of the goal of the present invention is formed by the periphery of the net, stretched by the resilient poles. Said resilient poles can exert a sufficient stretching force without being bulky and heavy, since they are significantly deformed when the goal is assembled. If similar poles were used to form the frame of the conventional goal, the goals' outline would be unacceptably distorted by the tension of the net. Thus, the shape of the goal of the present invention is maintained not by bulk and rigidity, but by the relation of forces, exerted by the light resilient elements.

(b) it is safe, because it does not have rigid posts or other rigid elements exposed to the player.

The only comparatively rigid elements that are exposed to the player above the playing surface are the upper outer ends of the resilient poles, which give in when the player runs or falls upon the goal and readily get back when the pressure is removed;

(c) its set up and removing times are short due to the small number of easy made connections;

(d) the preferred embodiment of this goal allows for easy changes of size and shape because pivotally connected stretching members can be used with nets of both oblong and square shape and are easily attached thereto only at four points;

(e) it has high rebounding properties since it acts on the ball like a bow acts upon an arrow;

(f) it can be set perpendicular and at other desirable angles to the playing surface, since the plane of the goal is pivotally attached to the playing surface and support has adjustable length and can be fixed to the playing surface at various distances from this plane;

(g) it can be set with any of its sides on the playing surface because all its sides are structurally similar to each other. In effect it provides two different shapes of the goal: one oblong vertically and another oblong horizontally;

(h) it can be used as a module to form goals and backstops of various shapes and sizes. Since all sides of the goal of present invention are structurally similar and don't include rigid elements, several of them can be easily connected together.

Although the description above contains many specific details, they merely provide illustrations of some of the presently preferred embodiments but should not be construed as limiting the scope of the invention. For example, net 22 can be easily made not only of rectangular shape, but of other (for instance, hexagonal) multilateral shape with obvious changes in connector 26 and in number of poles 24.

It is easy to see, that net-poles-connector assembly 31 can be used in various applications other, than sports games either with or without retainers 32 and support 30. For example, for displaying purposes solid flexible sheet material with a text or picture to be displayed can be used instead of net 22. If this sheet material has a light-reflecting layer, net-poles-connector assembly 31 can be used as a reflector in photography and the like.

Thus the scope of invention should be determined by the appended claims and their legal equivalents, rather than by the examples given.

Having thus described my invention, I claim:

1. A sports goal comprising:

(a) a net means having a plurality of corners; said net means adapted to be supported so as to impede the flight of a game projectile;

(b) a plurality of elongated resilient pole means; each of said pole means having an inner end and an outer end; each of said outer ends adapted to be attached to a respective corner of said net means;

(c) a connecting means adapted to connect said pole means together said connecting means comprising a plurality of joint members and a coupling means; each of said joint members having two substantially opposite receiving ends; each of said receiving ends adapted to provide connection with said inner end of one of said pole means; said coupling means rotatably connecting said joint members together;

wherein said net means, said pole means, and said connecting means so constructed and arranged that when said inner ends of said pole means are connected to said connecting means, but said outer ends of said pole means are not attached to said respective corners of said net means, said outer ends extend substantially beyond said respective corners outwardly so, that in order to attach said respective corners to said outer ends said pole means have to be substantially bent so as to deflect said outer ends inward.

2. The sports goal as in claim 1, wherein said joint means are arranged to provide telescopic connection with said inner ends of said pole means.

3. The sports goal as in claim 1, wherein said joint members are elongated and substantially rigid.

4. The sports goal as in claim 2, wherein said joint members are elongated and substantially rigid.

5. The sports goal as in claim 1, further comprising a retaining means adapted to secure a lower edge of said sports goal to a playing surface.

6. The sports goal as in claim 2, further comprising a retaining means adapted to secure a lower edge of said sports goal to a playing surface.

7. The sports goal as in claim 3, further comprising a retaining means adapted to secure a lower edge of said sports goal to a playing surface.

8. The sports goal as in claim 4, further comprising a retaining means adapted to secure a lower edge of said sports goal to a playing surface.

9. The sports goal as in claim 5 further comprising a support means having an upper end and a lower end; said upper end of said support means being attached to said connecting means; said lower end of said support means being attached to said playing surface;

said support means being adapted to support said sports goal so, that said net means is in a position to impede the flight of the game projectile.

10. The sports goal as in claim 6 further comprising a support means having an upper end and a lower end; said upper end of said support means being attached to said connecting means; said lower end of said support means being attached to said playing surface;

said support means being adapted to support said sports goal so, that said net means is in a position to impede the flight of the game projectile.

11. The sports goal as in claim 7 further comprising a support means having an upper end and a lower end; said upper end of said support means being attached to said connecting means; said lower end of said support means being attached to said playing surface;

said support means being adapted to support said sports goal so, that said net means is in a position to impede the flight of the game projectile.

12. The sports goal as in claim 11, further comprising adjusting means to vary the distance between said upper and lower ends of said support means.

13. A sports goal comprising:

(a) a net means having a plurality of corners; said net means adapted to be supported so as to impede the flight of a game projectile;

(b) a plurality of resilient stretching members adapted to stretch said net means; each of said stretching members having two opposite ends adapted to be connected to two diagonally opposite of said corners of said net means; said stretching members connected to each other approximately in the middles thereof;

wherein each of said stretching members being substantially longer than the respective diagonal of said net means, so that in order to connect said ends of said stretching members to said corners of said net means said stretching members have to be substantially bent so as to deflect their ends inward.

14. The sports goal as in claim 13, further comprising a retaining means adapted to secure a lower edge of said sports goal to a playing surface.

15. The sports goal as in claim 12, further comprising a support means having an upper end and a lower end; said upper end of said support means being attached to said stretching members; said lower end of said support means being attached to said playing surface;

said support means being adapted to support said sports goal so that said net means is in a position to impede the flight of the game projectile.

16. The sports goal as in claim 15, further comprising adjusting means to vary the distance between said upper and lower ends of said support means.

17. The sports goal as in claim 13, wherein each of said resilient stretching members is comprised of a plurality of engageable and disengeagable segments.

18. The sports goal as in claim 13, wherein each of said resilient stretching members is comprised of a plurality of segments and a plurality of hinge members; said hinge members provide connection between said segments so that said resilient stretching means can be folded into a transportation mode and unfolded into an operational mode.

19. A sports goal comprising:

(a) a net means having a plurality of corners and a plurality of structurally similar sides; said net means adapted to be supported with any of said structurally similar sides on a playing surface so as to impede the flight of a game projectile;

(b) a stretching assembly adapted to stretch said net means; said stretching assembly including a plurality of arms extending outwardly toward said corners of said net means; each of said arms having an outer end adapted to be connected to one of said corners of said net means;

(c) a retaining means adapted to secure one of said structurally similar sides of said net means to the playing surface;

(d) a support means having an upper end, a lower end, and an adjusting means; said upper end of said support means adapted to be rotatably connected to said stretching assembly; said lower end of said support means adapted to be attached to the playing surface; said adjusting means arranged to adjust the distance between said upper and said lower end of said support means to adjust a tilt of said net means and to provide a support for said net means with any of said structurally similar sides on the playing surface in the position to impede the flight of the game projectile.

20. The sports goal as in claim 19 wherein said arms of said stretching assembly being substantially resilient and sized so, that when said outer ends of said arms are not attached to said respective corners of said net means, said outer ends extend substantially beyond said respective corners outwardly so, that in order to attach said respective corners to said outer ends said arms have to be substantially bent so as to deflect said outer ends inward.

21. The sports goal as in claim 20, wherein each of said resilient arms is comprised of a plurality of engageable and disengeagable segments.

22. The sports goal as in claim 20 wherein each of said resilient arms is comprised of a plurality of segments and a plurality of hinge members; said hinge members provide connection between said segments so that said resilient arms can be folded into a transportation mode and unfolded into an operational mode.

* * * * *